US006543709B2

(12) United States Patent
Huang et al.

(10) Patent No.: US 6,543,709 B2
(45) Date of Patent: Apr. 8, 2003

(54) GRAVITY FLOW AIR CLASSIFYING MILL

(75) Inventors: Ching-Chung Huang, Summit, NJ (US); Robin T. Voorhees, Basking Ridge, NJ (US)

(73) Assignee: Hosokawa Micron Powder Systems, Summit, NJ (US)

( * ) Notice: Subject to any disclaimer, the term of this patent is extended or adjusted under 35 U.S.C. 154(b) by 0 days.

(21) Appl. No.: 09/925,141

(22) Filed: Aug. 9, 2001

(65) Prior Publication Data

US 2002/0092938 A1 Jul. 18, 2002

Related U.S. Application Data

(60) Provisional application No. 60/261,593, filed on Jan. 12, 2001.

(51) Int. Cl.[7] ..... B02C 23/32

(52) U.S. Cl. ..... 241/19; 241/79.1; 241/80

(58) Field of Search ..... 241/79.1, 19, 80, 241/82, 97; 209/135, 143, 710, 714

(56) References Cited

U.S. PATENT DOCUMENTS

| | | | | |
|---|---|---|---|---|
| 2,236,548 A | | 4/1941 | Prouty | |
| 2,882,149 A | * | 4/1959 | Willems | 241/157 |
| 3,285,523 A | | 11/1966 | Duyckinck et al. | |
| 3,511,445 A | | 5/1970 | Ashdown | |
| 3,690,570 A | | 9/1972 | Root | |
| 3,951,347 A | * | 4/1976 | Tiggesbaumker et al. | 241/119 |
| 4,993,647 A | | 2/1991 | Williams | |
| 5,215,262 A | | 6/1993 | Binder | |
| 5,277,370 A | | 1/1994 | Schatz | |
| 5,375,776 A | | 12/1994 | Kupper et al. | |
| 5,836,527 A | | 11/1998 | Irwin et al. | |

FOREIGN PATENT DOCUMENTS

| | | |
|---|---|---|
| DE | 43 04 507 | 9/1993 |
| FR | 2665846 | 2/1992 |
| GB | 2 117 667 | 10/1983 |
| NL | Octrooi 77464 | 10/1954 |
| WO | WO 92/03227 | 3/1992 |

* cited by examiner

*Primary Examiner*—Mark Rosenbaum
(74) *Attorney, Agent, or Firm*—Winston & Strawn

(57) ABSTRACT

The invention relates to a classifying mill with a housing configured for containing a stream of particulate material. A particulate material feed inlet is associated with the housing for introducing the particulate material into the housing. A milling assembly is disposed within the housing and configured for grinding the particulate material into fines and oversize particles. A classifier comprising a classifier rotor is disposed within the housing and below the milling assembly. A fines output at the underside of the classifier is configured for extracting the fines from the classifier, and an oversize particle collector at the underside of the classifier is configured for extracting the oversize particles from the housing. The classifying mill is arranged such that the particulate material stream extends downward from the feed inlet, through the milling assembly, and subsequently through the classifier.

35 Claims, 9 Drawing Sheets

GRAVITY FLOW AIR CLASSIFYING MILL

CROSS-REFERENCE TO RELATED APPLICATIONS

This application claims the benefit of provisional application no. 60/261,593, filed Jan. 12, 2001, the content of which is expressly incorporated herein by reference thereto.

FIELD OF THE INVENTION

The present invention relates generally to powder processing technology. More specifically, the present invention relates to apparatuses for grinding or comminuting and for classifying particulate material and employing gravity to more evenly feed the material through the apparatus.

BACKGROUND OF THE INVENTION

The use of classifying and grinding apparatus is known and important to the production of many items such as pharmaceuticals, chemicals, food products, cosmetics, powder coatings, toners, plastics and paints. The trend towards the use of finer powders (smaller than 50 microns) in certain applications has led to the development of combination mills, which integrate the processes of grinding and air classification into a single circuit. In this type of apparatus, ground product is continuously discharged when it reaches the desired fineness, while material that is still too coarse continues to be ground.

Reducing the percentage of fines at a desired top size and increasing the product yield has been the focus of many powder processing applications. These industrial demands have become even more crucial for powder coating processing due to the need for fine powder coatings, such as in thin film and automotive applications.

Conventional mills have a configuration typified by U.S. Pat. No. 3,285,523 to Duyckinck et al. These mills apply high speed impact for size reduction and utilize a continuous internal recirculation of material to reduce oversize material which has not achieved the desired particle size. Classification is typically achieved using an integrated air classifier in the mill where forced air from below lifts ground material out of the grinding zone and circulates it to the classification zone. In the classification zone, particles smaller than the cut size of classification pass through the classifier and are then collected by a product collector. Oversize particles are sent back to the grinding zone.

Traditional milling equipment flows the material to be ground in an upward direction through the milling mechanism and then through the classifier. As a result, gravity works against the direction of flow, and hinders the proper flow of the material through the apparatus. The larger particles are harder to lift through the different parts of the classifying mill and tend to stay in the mill longer than desirable. This causes these particles to heat excessively, which is detrimental when the particles comprise a material that is heat sensitive, such as powdered paint, plastics, polymers, and food products, including chocolate. Additionally, excessive fines tend to be produced when gravity operates to prolong the residence time of the material in the apparatus. Also, as almost all powders are explosive or flammable, the reduction of heat buildup is highly desirable. Traditional classifiers additionally have regions in which the particulate material tends to accumulate and become trapped, which can also increase heating. This reduces the efficiency of the classifiers and can require that the apparatus be stopped completely for cleaning.

As a result of the extra heating, milling temperature control with very high air flow is often required to ensure satisfactory powder production rate and product quality. Particles at elevated temperature that result from impact fusion can clog machinery and result in a low quality output. In addition, the production of powders with excessive fines can cause problems in powder performance and handling: flow properties deteriorate, airborne dust increases, and process loss and waste can become a serious factor. Product quality may also deteriorate in certain applications, such as powder coating applications where the presence of very fine particles may cause paint rub-off.

Accordingly, there is a need for an classifying mill that can more efficiently process the material with reduced heating. The present invention satisfies this need.

SUMMARY OF THE INVENTION

The invention relates to apparatuses for grinding and classifying particulate materials. A preferred embodiment of a classifying mill constructed according to the invention has a housing configured for containing a stream of particulate material and a particulate material feed inlet associated with the housing for introducing the particulate material into the housing. A milling assembly is disposed within the housing and configured for grinding the particulate material into fines and oversize particles. A classifier that has a classifier rotor is disposed within the housing and below the milling assembly. At the underside of the classifier is a fines output that is configured for extracting the fines from the classifier. An oversize particle collector is disposed at the underside of the classifier and radially outward from the fines output and is configured for extracting the oversize particles from the housing. The housing is oriented substantially upright, and the classifying mill is arranged such that the particulate material stream extends downward from the feed inlet, through the milling assembly, and subsequently through the classifier.

The milling assembly includes a long-gap type milling assembly with a milling rotor, which has a radially outward portion extending to adjacent the housing, which preferably includes a plurality of beater plates. The outward portion defines a milling gap between the outward portion and the housing. Also, the rotor and the milling portion of the housing are configured for grinding the particulate material in the milling gap upon rotation of the rotor with respect to the housing. The milling portion of the housing of this embodiment includes a removable lining with ridges configured for increasing the grinding of the particulate material A particle return manifold is connected to return the oversize particles from the oversize particle collector to the housing to feed them through the milling assembly. A plurality of particle return inlets, each configured for connection to a particle return manifold, is provided in the housing for feeding the oversize particles from the oversize particle collector to the milling assembly.

A drive shaft of one embodiment drives the milling rotor. A bearing assembly supporting the drive shaft is disposed within the milling rotor. Also, this embodiment has a sweeper disposed adjacent the classifier rotor and a first wall portion of the housing, preferably disposed below the classifier rotor. The sweeper is movable with respect to the first wall portion in a sweeper direction along a sweeper path to remove the particulate material from adjacent the first wall portion, preferably centrifugally and around the classifier rotor to reach the oversized particle collector, which is open to the housing at less than the complete circumference thereof. Preferably, the sweeper is rotatable coaxially with respect to the classifier rotor.

The sweeper has an extension that extends into the material stream and which is disposed for moving the particulate material away from the first wall portion. A leading side of the extension faces in the sweeper direction. The leading side in this embodiment is angled away from the first wall portion. The preferred extension comprises a plurality of fins.

In an embodiment, the classifier comprising at least one fluid inlet disposed adjacent the first wall portion and radially inward from the outermost portion of the sweeper. This fluid inlet is configured for increasing the pressure within the sweeper for moving the particulate material centrifugally from the sweeper, and preferably feeds air into the apparatus.

A preferred classifier includes a guide channel connected with a classifying fluid inlet for receiving the classifying fluid, which is preferably air. The guide channel guides the classifying fluid along a channel path, extends substantially coaxially with the classifier rotor, and defines first and second orifices fluidly communicated with the housing. The second orifice is disposed further along the path than the first orifice and is larger than the first orifice. A third is preferably also provided, and is disposed further along the path than second orifice and is larger than the second orifice. The orifices in this embodiment are sizes for feeding the classifying fluid into the housing at about a same rate through each orifice. The preferred guide channel has a substantially constant width in a direction across the flow of the classifying fluid. Additionally, the orifices are oriented at an angle of more than about 45° and more preferably more than about 60° to the guide channel radius, which preferably extends substantially tangentially to the classifier rotor, and at least one of the orifices is tapered towards the interior of the housing.

In an embodiment of the invention, a blower or eductor is connected to the particle return manifold for blowing a fluid, preferably air, in the particle return manifold past the location at which the oversize particle collector intersects the return manifold, and at an angle thereto. This reduces the pressure in the oversize particle collector to help draw the oversize particles. An adjustable valve is also disposed in the oversize particle collector for controlling the pressure therein, and a feed inlet is connected to the particle return manifold, preferably downstream of the blower or eductor.

The preferred feed inlet is configured and disposed for introducing the particulate material into the milling assembly at an introduction location. The feed inlet also has a loading portion configured for receiving the particulate material at a location below the introduction location for delivery to the introduction location. The loading portion, for example, may comprise a hopper for loading the material.

In an embodiment of a method of grinding and classifying particulate material according to the invention, the material is fed into the apparatus to fall through into a milling rotor in a housing. The milling rotor grinds or comminutes the material into fines and oversize particles. A classifier rotor is used to classify the fines from the oversize particles, and these are separately removed from the apparatus. The oversized particles are returned through a return manifold to fall through the milling rotor for further grinding.

DETAILED DESCRIPTION OF THE PREFERRED EMBODIMENTS

Figure 1:
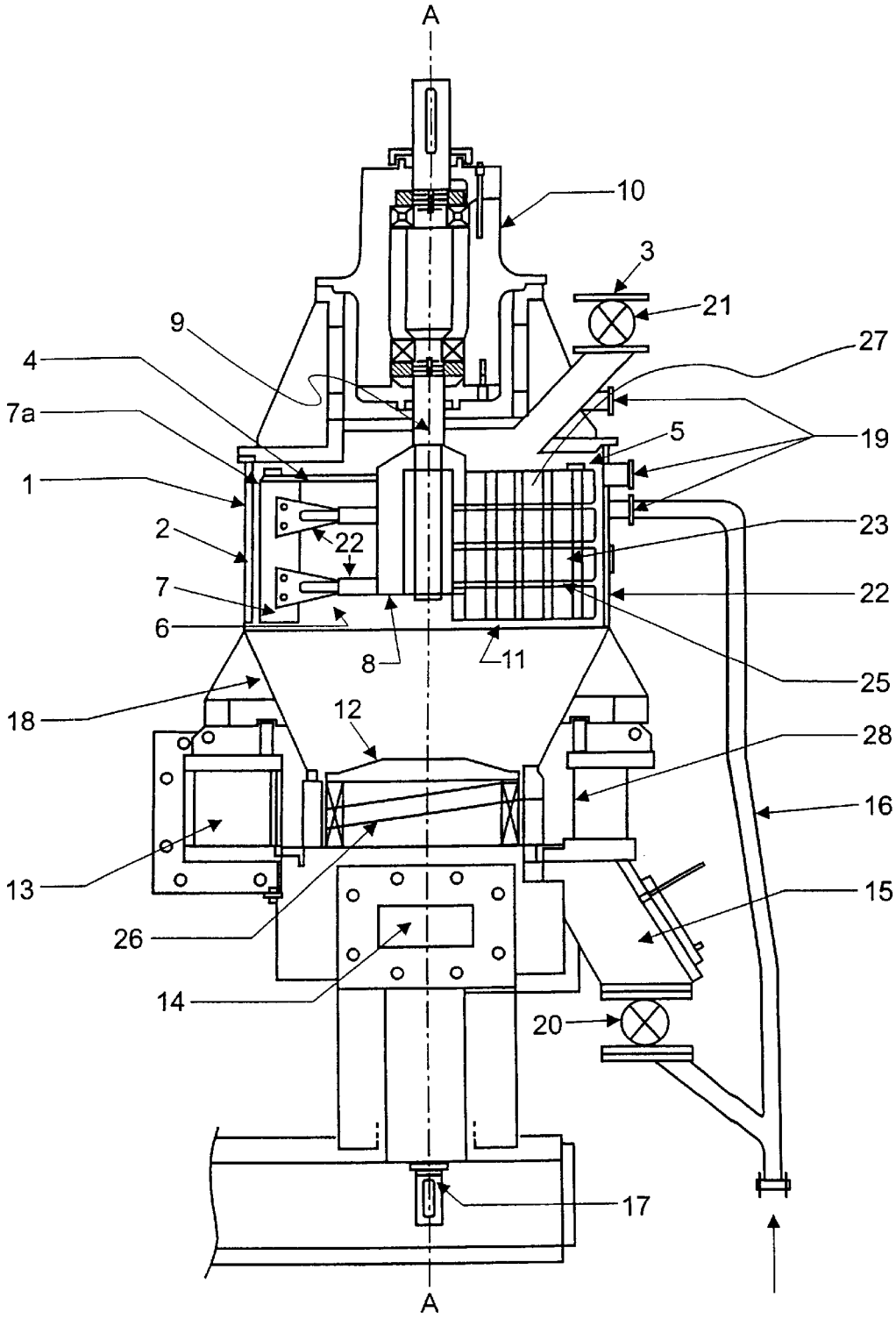
FIG. 1 is a cross-sectional, elevation view of two embodiments of a classifying mill constructed according to the invention, separated along the vertical line A—A.

In a preferred embodiment, raw material, approximately ¼" to ½" in diameter, can be reduced to a product which has a median size ($d_{50}$) below 100 $\mu$m and more preferably between about 20 to 40 $\mu$m. Median sizes of as low as about 5–15 $\mu$m can be achieved if desired. The present invention is directed to a process and apparatus which are capable of reducing introduced materials down to a desired size without creating excessive fines (e.g. particles less than about 10 $\mu$m). Temperature increases inherent in the grinding process are also reduced and air flow requirements are reduced. This invention is especially suitable for processing heat sensitive materials.

A milling assembly, preferably including a long-gap type milling assembly with milling rotor, is utilized for the reduction of raw material which is input through a feed inlet, which is preferably located at the top of the apparatus. After dispersion within the grinder housing, gravity flow is utilized to draw the material through the long gap milling zone, which minimizes the possibility of retaining any fines or generating excessive fines in the grinding section. On the other hand, due to the length of the grinding section, the material is thoroughly reduced in size by the time that it exits the grinding section, thereby reducing the number of oversize particles (particles larger than the desired top size, which might range from several hundred $\mu$m to below 25 $\mu$m, depending on the desired particle requirements) which will have to be recirculated for further grinding. The length of the grinding section also allows rotor speeds to be decreased while maintaining the required milling intensity to achieve the desired material size reduction. The processed material falls directly onto a classifier rotor after being processed by the milling rotor.

The classifier rotor of the preferred embodiment, located below the grinding section, receives the processed material, separates particles smaller than the cut size of classification from the material stream and directs them into and then below the classifier rotor to a fines outlet where vacuum pressure is applied. An air inlet located tangentially to the edge of the classifier rotor supplies airflow to enhance the vortex flow around the classifier to assist its classification efficiency. The air inlet also serves as an additional source of cooling air to maintain material temperatures at desired levels. Oversize particles are rejected by the classifier and entrapped in this vortex airflow created around the classifier rotor and thrown by centrifugal force to the outside of the classification section where they are dropped into a collector for oversize particles. The oversize particles are then discharged through an airlock located below the classifier housing and then recirculated by an external particle return manifold to the grinding section above. The presence of the external particle return manifold affords an additional opportunity to manage the temperature of material so as to keep it within allowable boundaries. An optional blower, eductor, or air pump may be utilized to assist in the movement of particles through the particle return manifold.

After passing through the particle return manifold, recirculated oversize particles can be introduced into various stages of the grinding process as is required to attain the desired amount of re-grinding. This prevents the over grinding of near cut-size particles and "good" fines that may be trapped along with the oversize particles which are returned to the milling rotor. The production of excessive fines is also minimized in this manner.

The detailed description will be better understood in conjunction with the accompanying drawing.

Referring to FIG. 1, this embodiment has a vertical axis and a housing 22, which includes a grinder housing 1, a transition housing 18, and a classifier housing 28. The housing 22 is preferably oriented substantially upright, and preferably configured and oriented so that the particulate material flows assisted by gravity through the grinder housing 1 and also to and through the transition and classifier housings 18,28 to the classifier rotor 12.

The grinder housing 1 preferably extends vertically along the axis of the mill and contains a milling assembly. The grinder housing 1 is cylindrical in plan and has provisions for the attachment of various intakes and supports. The grinder housing 1 is itself connected with the rest of the unit in a manner which allows for easy access and removal so as to allow for maintenance and cleaning. In one embodiment, the grinder housing 1 is hinged to allow easy access to the milling rotor 6 and to the classifier rotor 12 for removal and service. The inner surface of grinder housing 1 has a removable lining 2 attached to it along the circumference of the grinder housing 1. The removable lining 2, made of a durable material such as steel, may have a cross-sectional profile which is shaped to achieve a particular grinding effect and may be interchanged with other lining types with different profiles if desired. In one embodiment, the lining is formed with ridges which lie parallel to the vertical axis of the mill. The ridges compound the grinding which occurs as the raw material passes through the mill, as further described below. It is preferable that removable lining 2 be secured to the inner surface of grinder housing 1 in such a manner that it may be removed and replaced easily.

A raw material feed inlet 3 is located above the grinder housing and directs material which is to be processed to dispersion disk 4 which is located inside the grinder housing. An airlock 21 is built into the feed inlet to allow the feeding of raw material into the housing without allowing air into the vacuum which exists within the grinding housing when the apparatus is in operation.

Dispersion disk 4, located below the feed inlet, rotates rapidly and acts to spread out and break apart large clumps of raw material fed into the mill and also ensures that the material does not pass radially within beater plates 7. Dispersion disk 4 may have a plurality of dispersion blades 5, preferably four dispersion blades 5, located on its upper surface so as to facilitate and improve the dispersion of the incoming material stream. Depending on the type of dispersion blades used, the dispersion disk can also serve as a pre-grinding stage. The dispersion blades in one embodiment are in the form of bars with a rectangular cross-section, extending radially outwards from the center of dispersion disk 4. It is preferable that dispersion blades 5 are secured to dispersion disk 4 in such a manner that they may be removed and replaced easily, to match the needs of a particular task.

Dispersion disk 4 forms the top surface of milling rotor 6 which includes a plurality of beater plates 7 extending downwards from the dispersion disk, parallel to the axis of the mill, as shown on the left side of line A—A. Alternatively, the long beater plates 7 can be replaced with a plurality of segmented beater plates 23, preferably mounted on the multiple stage milling rotor 11, as shown on the right side of line A—A. The segmented plates 23 are preferably disposed end to end or offset to each other to achieve a similar or the same grinding effect as the long beater plates 7 and so that each segmented plate can be replaced separately. Horizontal disks 25 can also be interposed between the segmented milling rotors 27 to help direct the particular material outward towards the milling gap 7*a*.

The milling rotor 6 is where the most significant portion of the grinding operation occurs as the rotor spins. Beater plates 7 are preferably generally rectangular, steel plates designed to break down and reduce the size of particles as they fall through the long gap 7*a* between the lining 2 and the milling rotor 6. The length of the beater plates 7 is optimized to provide the desired material size reduction without over grinding, which would produce excessive fines. The steel plates can be hard-faced with wear resistant material for milling abrasive substances. The long gap 7*a* has a length that is several times longer than the width of the long gap 7*a,* and extends substantially axially with respect to the milling rotor 6. The length of the long gap 7*a* is preferably at least about ten times the width, and more preferably at least about twenty or thirty times, and preferably less than about one hundred times. In the preferred embodiment, the gap width is between about 2 mm and 5 mm, and the length is between 100 and 200 mm.

The beater plates 7 are supported and driven by beater arms 22 which attach to rotating hub 8. First drive shaft 9 is secured to rotating hub 8 which supports the dispersion disk 4 and the beater arms 22. As the incoming feed falls upon dispersion disk 4, the material is driven by centrifugal action towards the outer portions of the disk and housing as it is dispersed and broken up. Gravity flow carries dispersed material down to the long gap 7*a* between the beater plates 7 and the lining 2, where the material is reduced in size by the action of the rotating beaters and interaction with the housing lining 2. Due to the vertical length of beater plates 7, particulate matter is thoroughly reduced as it travels downwards through long gap 7*a*. The increased exposure to the beater plates 7 results in a more efficient reduction of particulate matter in a single pass through the milling rotor. This reduces the need for recirculating processed material and improves processing production rates. Also, rotor speeds may be reduced because the increased exposure time to the beater plates reduces the need for high speed impact to break down material as is required by a conventional impact mill. By reducing rotor speeds, temperature rise is reduced as is impact fusion of processed particles.

In an alternative embodiment, milling rotor 6 is replaced by a multiple stage milling rotor 11. The multiple stage milling rotor 11 is preferably constructed so that it may be easily reconfigured to adjust the length or number of beater plates or segmented beater plates in order to vary the grinding characteristics for different material specification requirements. Where the beater plates are segmented, the length of the long gap 7*a* is measured across all of the longitudinally successive, adjacent blades, even if the longitudinally successive, adjacent blades are displaced circumferencially with respect to each other. The dimensions and geometry of the beater plates 7 can also be varied to meet the need of specific milling requirements. In addition, a disk can be installed at the bottom of the milling rotor 6 to prevent material deposition in the milling rotor 6 if necessary.

First drive shaft 9 extends upwardly from milling rotor 6 and is driven by an external driving source. Drive shaft bearing housing 10 is located above the grinder housing and supports first drive shaft 9.

Ground material from milling rotor 6 falls to a classifier rotor 12 located within classifier housing 28 below milling rotor 6. Classifier rotor 12 of the embodiment shown has the general design of a vertical-axis classifier as described in U.S. Pat. No. 6,109,448, and preferably includes a plurality of classification blades between which the fines pass during classification. The ground material routed to the periphery of the classifier rotor 12. A stationary guide vane ring may be arranged around the periphery of the classifier rotor to assist in creating a vortex flow around the classifier rotor. Depending on the applications, this stationary guide vane ring may be in the form of a single tangential air inlet. A helical vane 26 preferably runs coaxially to the classifying wheel and permits control of the residence time and the concentration of product in the classifying chamber, which makes it possible to separate out a greater portion of the fines through the classifier rotor. Classifier rotor 12 is driven by a second drive shaft 17 which extends downwards from the classifier rotor and is driven by an external driving source.

Fines outlet 14, located underneath the classifier, has a vacuum applied to it and air is pulled from air inlet 13 through the classifier housing 28 and also from the grinding section above the classifier rotor 12. Air inlet 13 provides air at atmospheric pressure to assist the classifier in the creation of a vortex flow for particle classification and also to help lower the temperature of processed material Classifying air flows through the classifying wheel in a centripetal direction and fines are routed to the inside of the rotor. These fines are directed through the bottom of classifier rotor 12 and out through the fines outlet 14. Coarse material which has not been reduced to the desired size is directed by the vortex flow around classifier rotor. Gravity causes the rejected coarse material to move downwards to a collector for oversize particles 15. In one embodiment of the invention, a cyclone may be positioned to collect and remove oversize particles which are caught in the vortex flow. The cyclone may be fitted with an adjustable gate in the form of a wall member of the classifier housing to optimize the collection and removal of particles. An airlock 20 regulates the airflow direction in the mill and allows the oversize material to be discharged from the particle collector 15 to the external particle return manifold 16.

The use of gravity flow to move the material through the milling rotor 6 and down to classifier rotor 12 allows the use of reduced airflow while maintaining material temperatures which are appropriate for temperature sensitive material. In comparison, a standard air classifying mill which moved processed material against gravity requires a very high rate of airflow to prevent temperatures from increasing above allowable levels as the material tends to recirculate internally. The lower airflow also reduces impact fusion and lowers overall costs as the airflow requirements and associated equipment costs are reduced. Additionally, because return manifold 16 is external to the grinder housing 1 and classifier housing 28, temperature control of the material to be recirculated can be carefully controlled, an important factor in milling many heat sensitive materials.

Grinder housing 1 can be equipped with one or more alternate particle return inlets 19. Particle return manifold 16 is routed back to grinder housing 1 and can be connected to either feed inlet 3 with a collection cyclone or to an alternate particle return inlet 19 as required under the circumstances. These alternate return feed inlets 19 allow processed material to enter through the grinder housing and into the milling rotor 6 at a lower stage of the milling assembly, further downstream from the feed inlet 3 and thus reduces the amount of reprocessing of material which has already been through the mill and has already been reduced somewhat in size. This contributes to the reduction of excessive fines over that found in convention mills. In an alternative embodiment, the particle return manifold 16 and feed inlet 3 can be set up to convey feed stock at the floor level to ease in the handling of raw feed material. In this case, the raw feed material and over-size particles are preferably air conveyed together to the top of the grinder housing.

EXAMPLES

Figure 2:
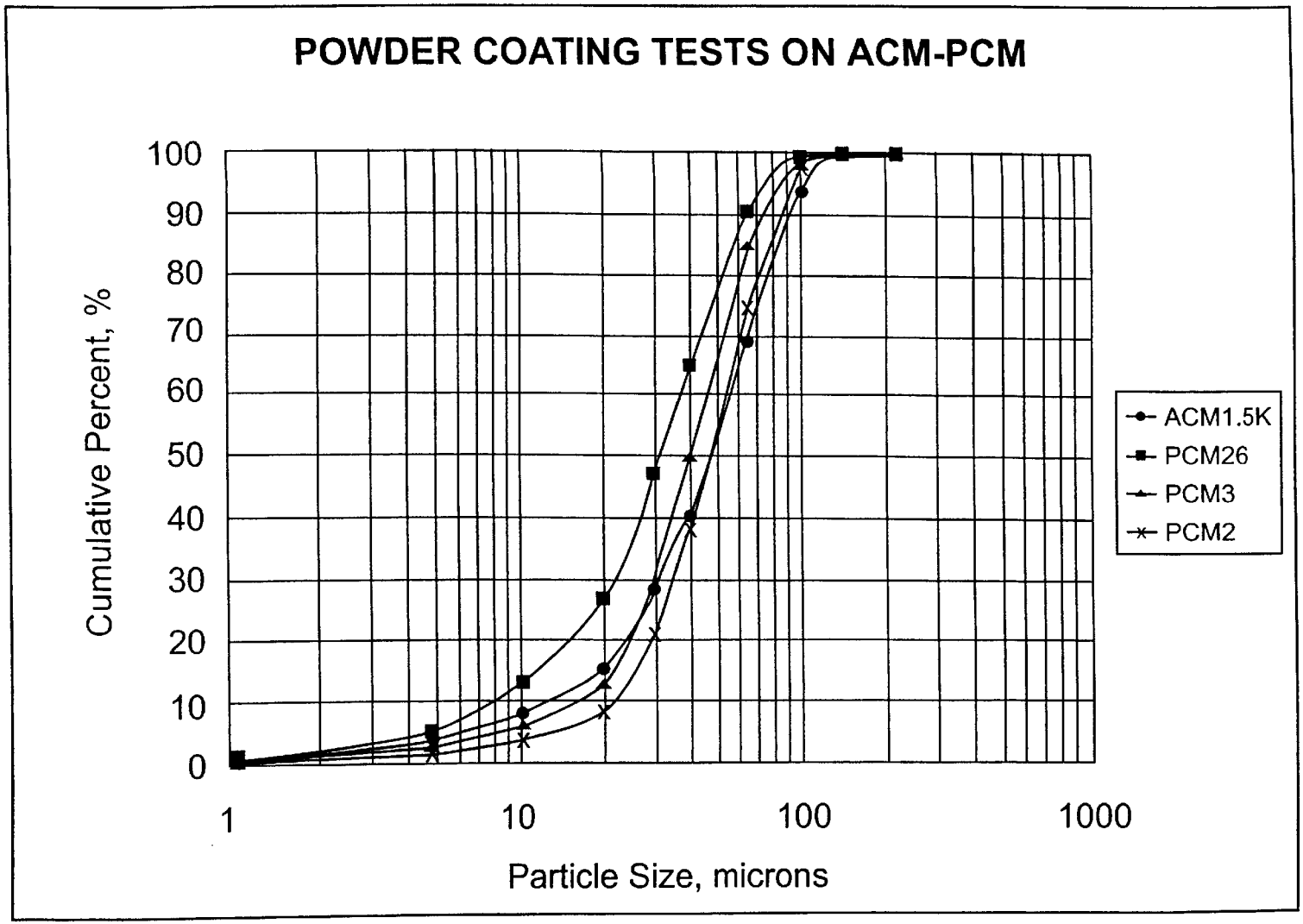
FIGS. 2 and 3 show the results of particle size distribution tests.

A number of test runs have demonstrated the ability of the invention to achieve the desired results. FIG. 2 shows the comparison of particle size distribution of powder coatings obtained from this trial as oversize particles were collected separately (an open loop system) and that from a conventional mill trial. The conventional mill could produce a product with a particle size distribution of 100%<100 μm with a classifier speed of 2000 rpm (as seen on curve ACM2K), but fines were at 12.97%<10 μm. Reducing the classifier speed on the conventional mill could decrease the fines to 7.62%<10 μm, but the product became too coarse with a product size distribution of 94.4%<100 μm (as seen on curve ACM1.5K). At a low feed rate, the invention could produce product at 97.86%<100 μm and 3.42%<10 μm (as seen on curve PCM2). The product became finer as the feed rate increased. The invention produced product at 99%<100 μm and 5.56%<10 μm at a higher feed rate (see curve PCM3).

Figure 3:
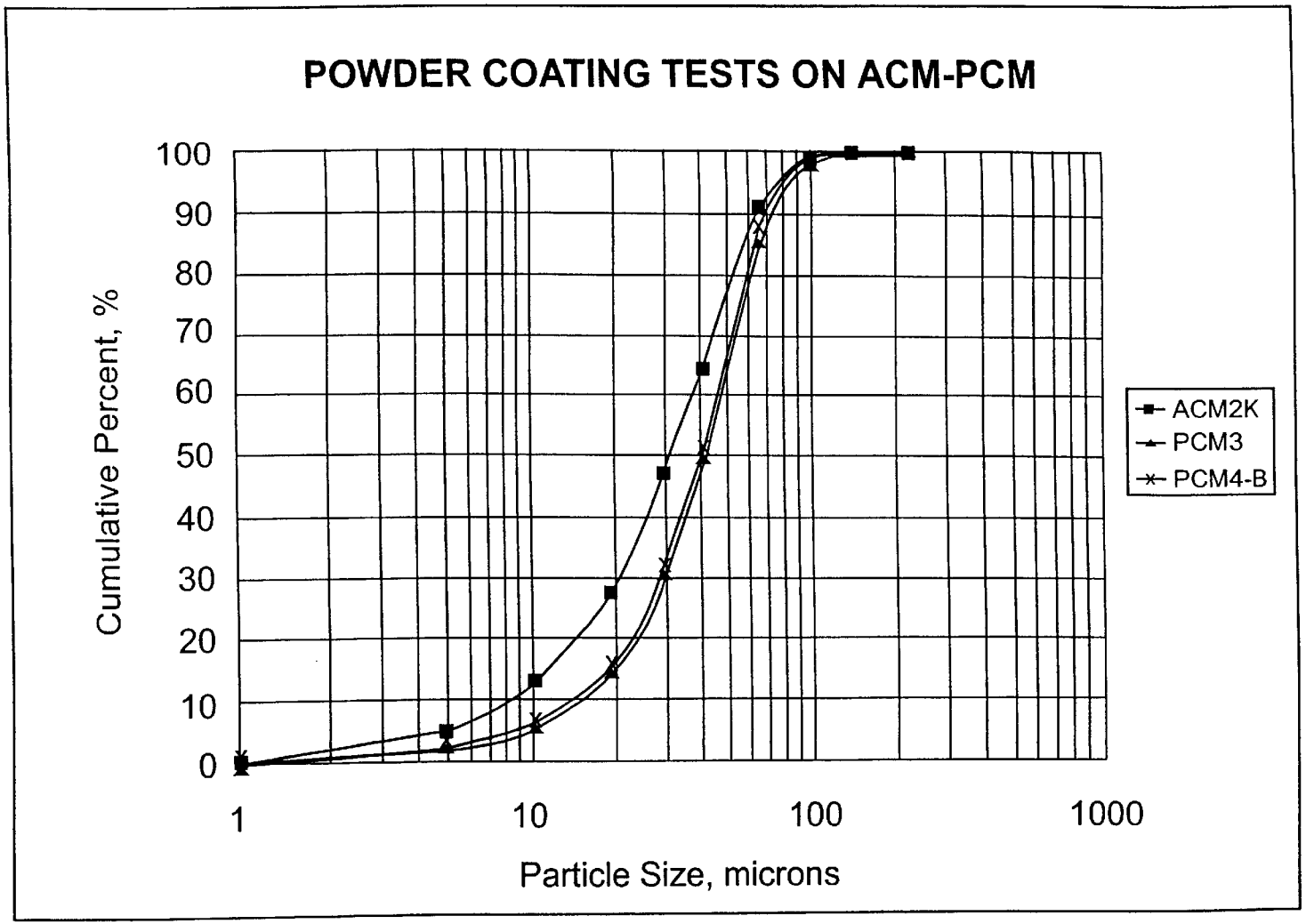

A closed loop milling trial was run by recycling the oversize rejects to the feed inlet of the invention. In this case, the milling conditions were similar to those of curve PCM3, except at a slightly higher classifier speed of an increase of about 10%. The resulting ground product was finer (100%<100 μand 6.52%<10 μm) as shown on curve PCM4-B in FIG. 3.

Comparing the particle size distribution of the ground product of the conventional mill to that of the invention, it is seen that the invention has demonstrated its potential to produce powder coatings with fewer fines and with a tighter particle size distribution span.

Figure 4:
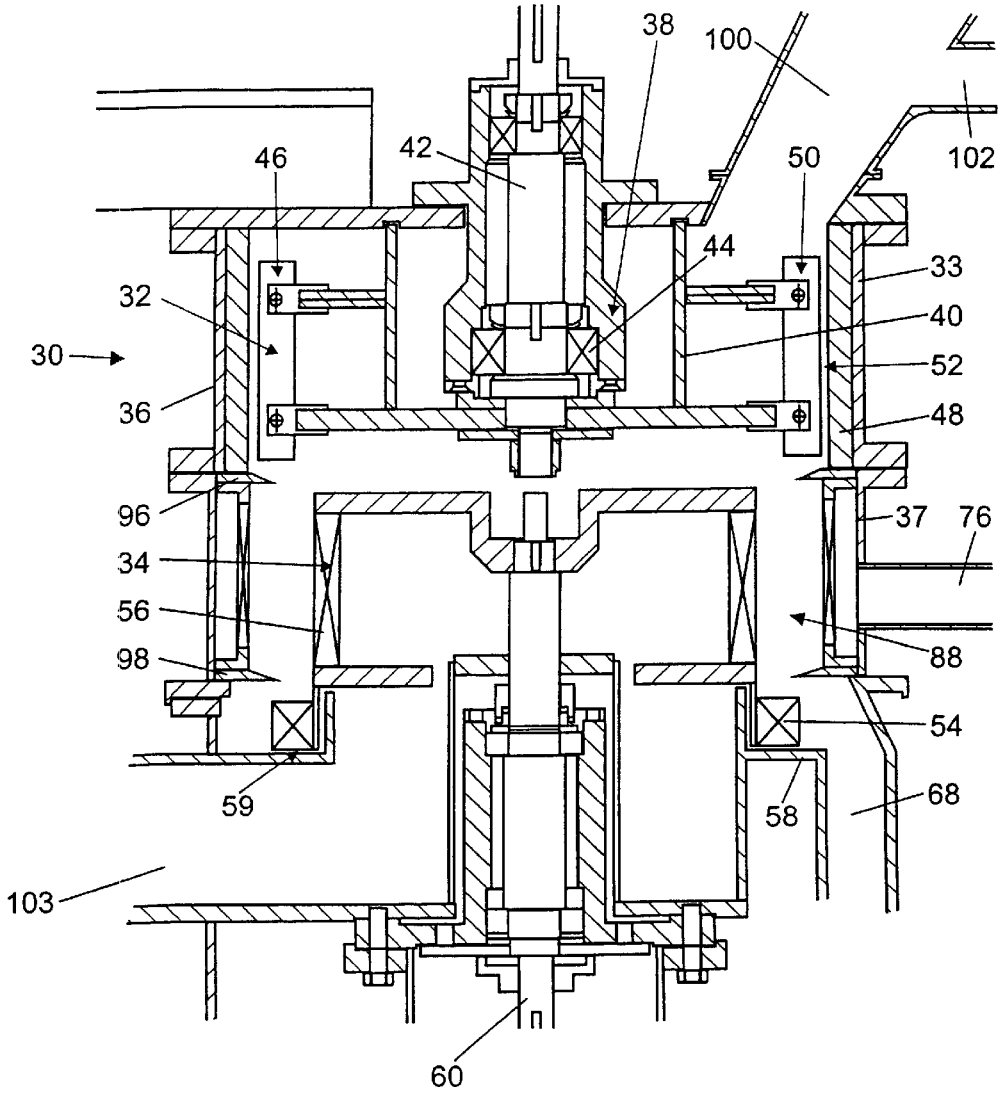
FIG. 4 is a cross-sectional view of another embodiment of a classifying mill of the invention.

Referring to the embodiment of FIG. 4, classifying mill 30 includes a milling assembly 32 in a milling portion 33 of a housing 36 and a classifier assembly 34 in a classifier portion 37 of the housing 36. The milling and classifier portions 33,37 of the housing 36 are preferably configured as a single housing, but may alternatively be configured as separate housings connected by a duct. The housings may also by connected by a hinge, and configured to hinge open to allow for easy access and maintenance of the milling assembly and for ease of cleaning the internal housing of the classifying mill.

A drive shaft bearing housing 38 is disposed within rotating hub 40. In this lower portion, the moment-arm acting on the drive shaft 42 is reduced and the life of bearings 44, supporting the shaft 42 and disposed within the rotating hub 40, is significantly improved. In addition, this position of the bearing housing facilitates the balancing of the milling rotor 46.

The milling assembly 32 of the embodiment shown comprises an outward portion disposed radially outward from the shaft 42 and extending to adjacent the housing 36, and preferably adjacent a milling lining 48, which is preferably removable and replaceable, with a profile to improve grinding of the particulate material. The outward portion of the milling rotor 46 preferably comprises a plurality of beater plates 50 that define a milling gap 52 with the lining 48 of the housing 36.

The classifier assembly 34 also includes a sweeper 54, which is preferably disposed adjacent and below classifier rotor 56. The sweeper 54 is disposed adjacent and above bottom wall portion 59 of the classifier housing portion 37, which bounds the space downstream of the classifier rotor 56. The sweeper 54 is movable with respect to the wall portion 58 in a sweeper direction along a sweeper path for removing the particulate material from adjacent the wall portion 58, and is preferably rotatable. Preferably, the classifier rotor 56 is fixed to the sweeper 54 for coaxial rotation therewith, but the sweeper may alternatively be rotated in a different manner, such as by frictional engagement with the classifier rotor 56 or classifier shaft 60.

Figure 5:
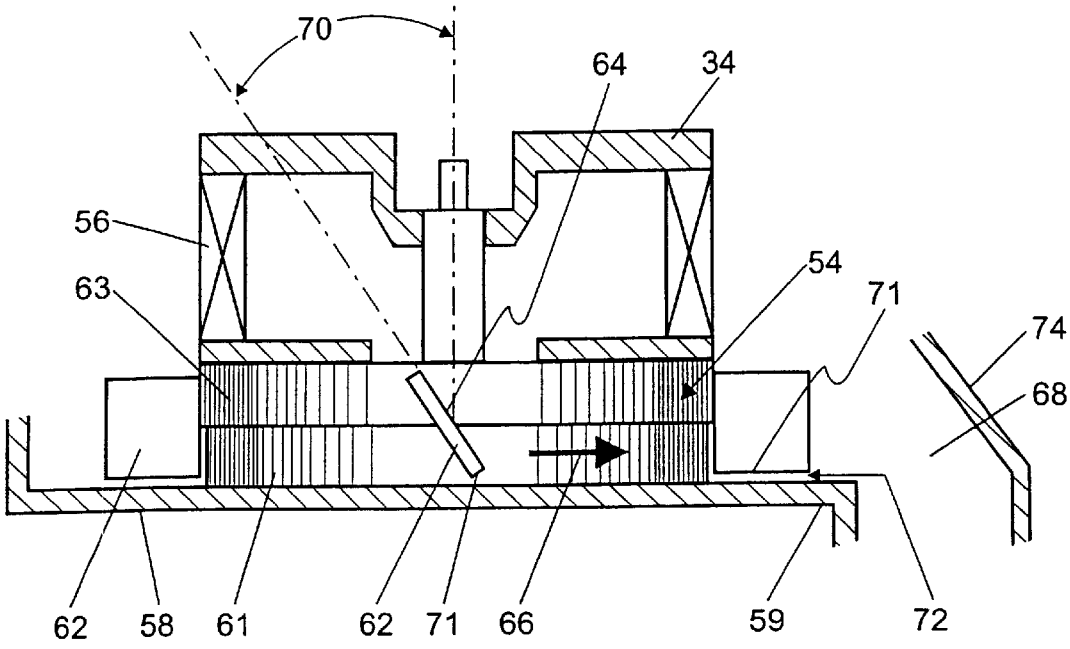
FIG. 5 is a partial cross-sectional view of a classifier assembly thereof.

Referring to FIG. 5, the sweeper 54 has extensions extending radially into the stream of material, which due to the location of the sweeper 54 downstream of the classifier rotor 56, mainly includes oversize particles. The extensions preferably comprise fins 62, which have a leading side 64 with respect to the sweeper direction of movement 66.

The fins 62 are attached to ring portion 63, which preferably extends axially and downwardly from the classifier rotor 56. The ring 63 is preferably spaced at least from the bottom wall portion 59 to avoid particle accumulation or fusion between the ring 63 and the bottom wall portion 59. The rotation of the fins 62 moves the particulate material around and away from the wall portion 58 and the classifier rotor 56. Oversize particle collector 68 is open to the housing 36 at less than the complete circumference thereof around the classifier rotor 56. Thus, by moving the particles around the wall portion 58 and classifier rotor 56, the sweeper 54 moves the particles towards the oversize particle collector 68 from locations around the wall portion 58 that are distant from the oversize particle collector 68.

In the preferred embodiment, the leading side 64 of the fins 62 is disposed at an angle to the sweeper direction 66 and is preferably angled away from horizontal portion 59. Preferably, the leading side 64 is inclined at an angle 70 of about between 0° and 60° to the axis of rotation of the sweeper 54, more preferably between about 20° and 45°, and most preferably between about 25° and 35°. This inclination both improves the radial displacement of the oversize particles from the wall portion 58, as well as displaces the particles upwards from the horizontal wall portion 59, while further mixing the particle stream.

The wall portion 58 of this embodiment includes a generally horizontal portion 59 and a generally vertical portion 61. The fins 62 preferably have a side facing the wall portion 58, in the embodiment shown this is the bottom side 71, which generally follows or matches the contour of the cross-section of the part of the wall portion 58 that it faces. The fins 62 displace the oversize particles outwardly towards oversize particle collector 68, which is disposed radially outwardly from the remainder of the oversize particle region below the classifier rotor 56, and preferably is tangential to the rotating stream of the rotating oversize particles.

Preferably, a gap 72 remains between the sweeper fins 62 and the adjacent wall portion 58. Also, the fins 62 are preferably spaced from each other. Both of these features facilitate the removal of the particulate material from adjacent wall portion 58 and help prevent the material from accumulating in a space between the sweeper 54 and the wall portion 59.

The sweeper fins 62 preferably face and are adjacent to the oversize particle collector 68. The oversize particle collector 68 preferably includes a flared wall portion 74 to allow the oversize particles to continue moving downwardly as well as outwardly from the classifier assembly 34. In the preferred embodiment, the wall portion 59 extends to the oversize particle collector 68 substantially smoothly, substantially without parts of the wall blocking smooth outward flow. Also, the bottom wall portion 59 preferably is horizontal or angles downward in an outward radial direction towards the oversize particle collector 68, without requiring substantially any upward flow to reach the oversize particle collector 68.

Figure 6:
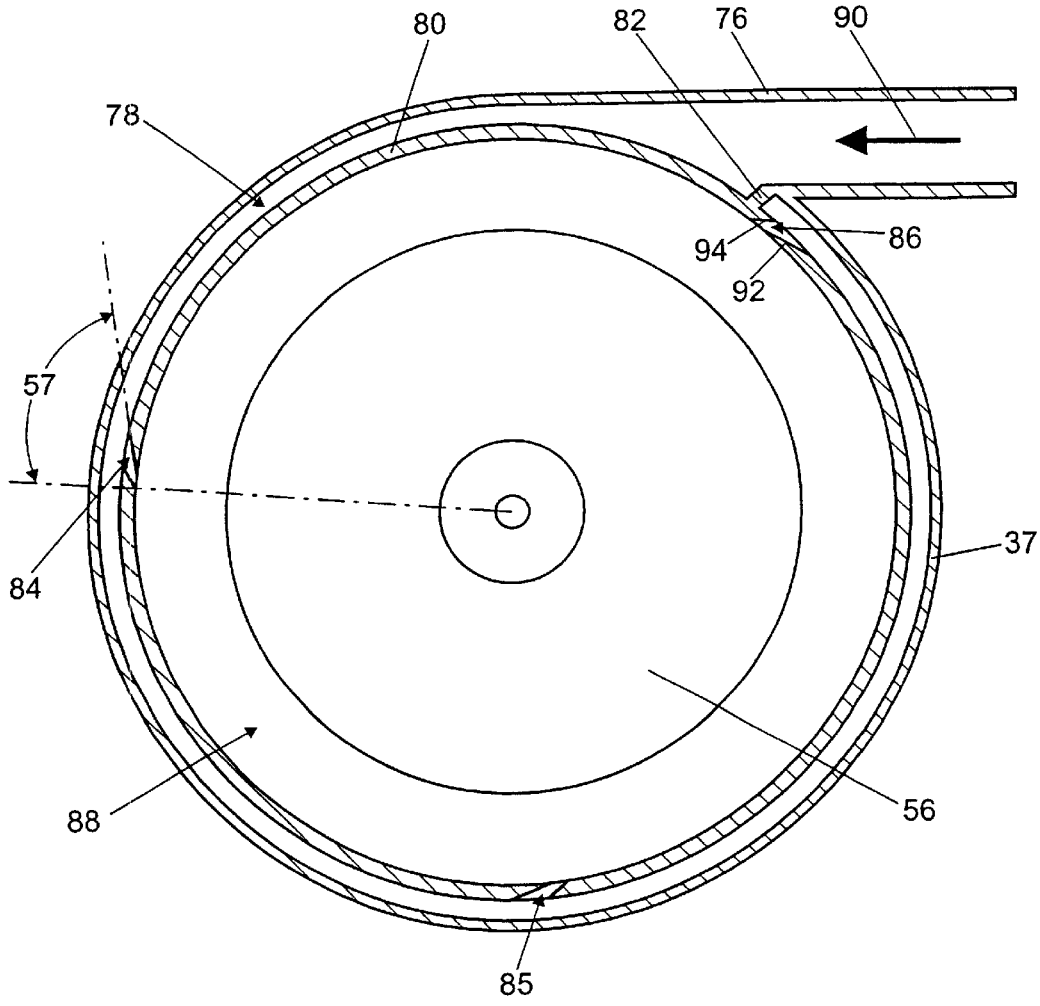
FIG. 6 is a top, partial cross-sectional view of a guide channel thereof.

Referring to FIGS. 4 and 6, classifier air inlet 76 feeds air into a guide channel 78 bounded by a guide vane 80 that extends about the classifier rotor 56 and is substantially coaxial therewith. The guide channel 78 has block 82 that blocks the airflow at the end of the channel 78. The guide vane 80 comprises at least one and preferably a plurality of openings 84–86 fluidly communicating the guide channel 78 to a classifying region 88 in the classifier portion 34, preferably adjacent the classifier rotor 56.

The orifices 84–86 preferably sequentially increase in size in the direction of the airflow path 90, and are preferably dimensioned to provide substantially the same airflow through each orifice 84–86, as the guide channel 78 preferably has a substantially constant width and radius. Thus, the first orifice 85 along the airflow path is smaller than the second orifice 85 along the path 90, which is smaller than the third orifice 86 along the path 90. In one embodiment, the first orifice 84 has a width at its tapered end of about 7⁄64", the second orifice has a tapered end width of about 3⁄16", and the third orifice has a tapered end width of about 17⁄64".

The preferred orifices 84–86 preferably are slots tapered towards their outlet in the classifying region 88 and are angled towards the direction of the airflow within the guide channel 78. The orifices 84–86 have a rear wall 92 oriented at a greater angle from the radius of the classifier rotor 56 than forward wall 94 thereof. The rear walls are preferably oriented at an angle 57 of between about 60° and 90° from the radius of the classifier rotor 56 and guide vane wall 80. Preferably, the forward wall is oriented at less than about 60° to the guide vane wall 80, which is preferably substantially tangential to the radius of the classifier rotor 56, and more preferably between about 10° and 40° degrees therefrom. An alternative embodiment has orifices that are formed generally perpendicular to the guide vane, and another embodiment comprises louvers to form the orifices.

Referring again to FIG. 4, a milling residence ring 96 is disposed adjacent and preferably below and downstream of the milling rotor 46, and a classifying residence ring 98 is disposed adjacent and preferably below and downstream of the classifying rotor 56. The residence rings 96,98 protrude into the housing 36 and the flow space through which the airborne particulate material flows by an amount sufficient to increase the residence time in the milling assembly 32 and classifier assembly 34, respectively. The milling residence ring 96 preferably protrudes beyond the thickness of the milling gap 52, and prevents the particulate material from falling through the milling assembly 32 too quickly from the raw material inlet 100 and recycled material inlet 102, and the prolonged residence time is controlled to obtain the desired milling of the particulate material. Similarly, the classifier residence ring 98 reduces the size of the exit for the oversize particles from the classifying zone 88, and controls the residence time of the particulate material therein.

On the bottom inside of the classifier rotor 56 is disposed a fines outlet 103. Fines outlet 103 is disposed radially inwardly from the oversize particle collector 68 with respect to the classifier rotor 56. Suction is applied to the fines outlet 103 to reduce the pressure within the classifier rotor 56 and to control the proper material and air flow within the classifying mill.

Figure 7:
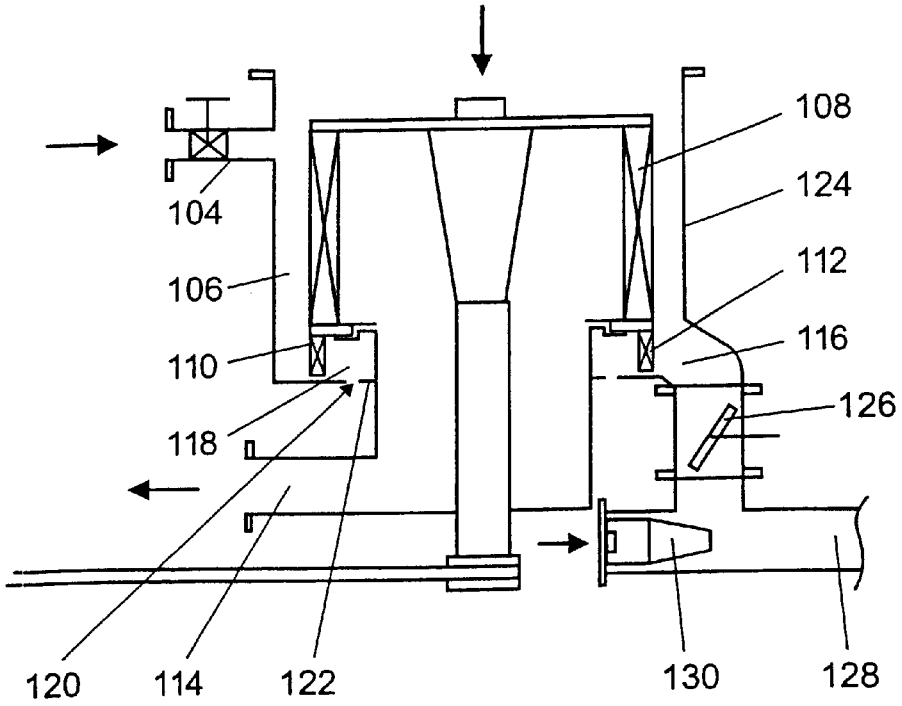
FIGS. 7–9 are side views of alternative embodiments of classifier portions according the invention.

Referring to FIG. 7, another embodiment of the classifier portion is disposed to receive the ground or milled particulate material from a milling assembly above the classifier, with the assistance of gravity. An air inlet 104 introduces air into the classifying zone 106. As in the previous embodiments, a suction is applied to the fines outlet 114, which is connected to the center section of the classifier rotor 108.

Classifier rotor 108 is fitted with fins 110 of a sweeper 112 which rotate with the rotor 108 for directing the particulate material out from the space 118 beneath and downstream from the classifier rotor 108 and towards the tangential oversize particle collector 116. An air inlet opening 120 is provided in the bottom wall portion 122 of the housing 124 to allow air to enter the space 118, as the ambient pressure is preferably greater than the pressure inside the housing 124 due to the extraction of air through the fines outlet 114 and the fanning effect of rotating fins 110. Air thus flows into the space 118, and outwardly past the rotating fins 110 to further improve the removal of any particles that may otherwise become trapped in the space 118 by increasing the pressure radially on the inside of the sweeper. The opening 120 is preferably disposed radially inwardly of the outermost part of the fins 110, and preferably inwardly from the fins 110.

The embodiment of FIG. 7 additionally includes a valve 126 in the oversize particle collector 116 leading to the recycling manifold 128, which feeds the oversize particles back to the milling assembly. The valve may comprise a butterfly valve or other valve suitable for controlling the pressure within the oversize particle collector 116, especially on the side of the classifier. Preferably, the valve 126 is adjustable. There is preferably no blockage or pump to prevent the reverse flow of oversize particles, as this is controlled by adjusting the pressures in the different parts of the apparatus.

A blower 130 is connected to the particle return manifold 128 for blowing air therein. The blower is disposed and configured preferably for blowing the air past the location at which the oversize particle collector 116, preferably at an angle to the oversize particle collector 116 to reduce the pressure in the oversize particle collector 116 and help extract the oversize particles from the classifier. Other locations of the blower are also possible, but it is preferred to speed up the airflow across the oversize particle collector 116 to reduce the pressure therein. In one embodiment, no blower is present, and the pressures within the housing are controlled to obtain the desired air and particle flow.

Figure 8:
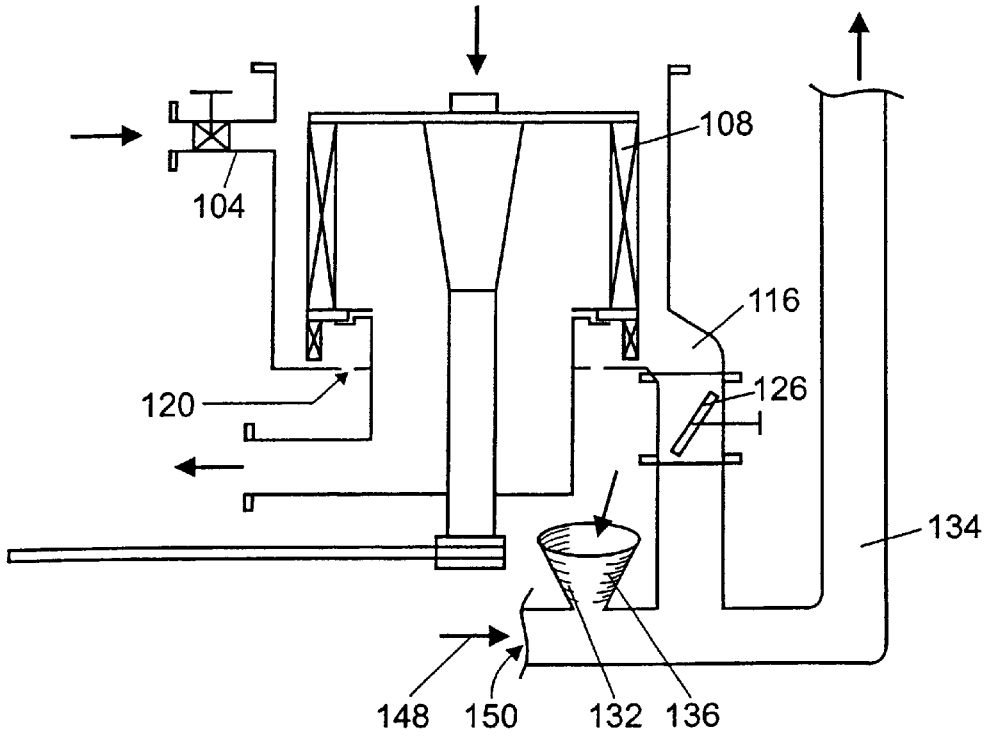

The embodiment of FIG. 8 additionally comprises a material feed inlet 132 connected to the particle return manifold 134. The feed inlet comprises a hopper 136 in the embodiment shown and is preferably disposed near floor level, or near or below the bottom of the housing to facilitate loading the raw material into the feed inlet 132. The feed inlet 132 is preferably connected to the return manifold 134 upstream of the position at which the oversize particle collector 116 feeds into the return manifold 134 when no blower is present. In the embodiment shown, the return manifold 134 has an open end 150 to intake air 148 at atmospheric pressure outside of the housing. The feed inlet 132 can be connected to the return manifold 134 downstream of the connection between the oversize particle collector 116 and the return manifold 134, with a blower disposed upstream or substantially at the oversize particle collector 116.

Figure 9:
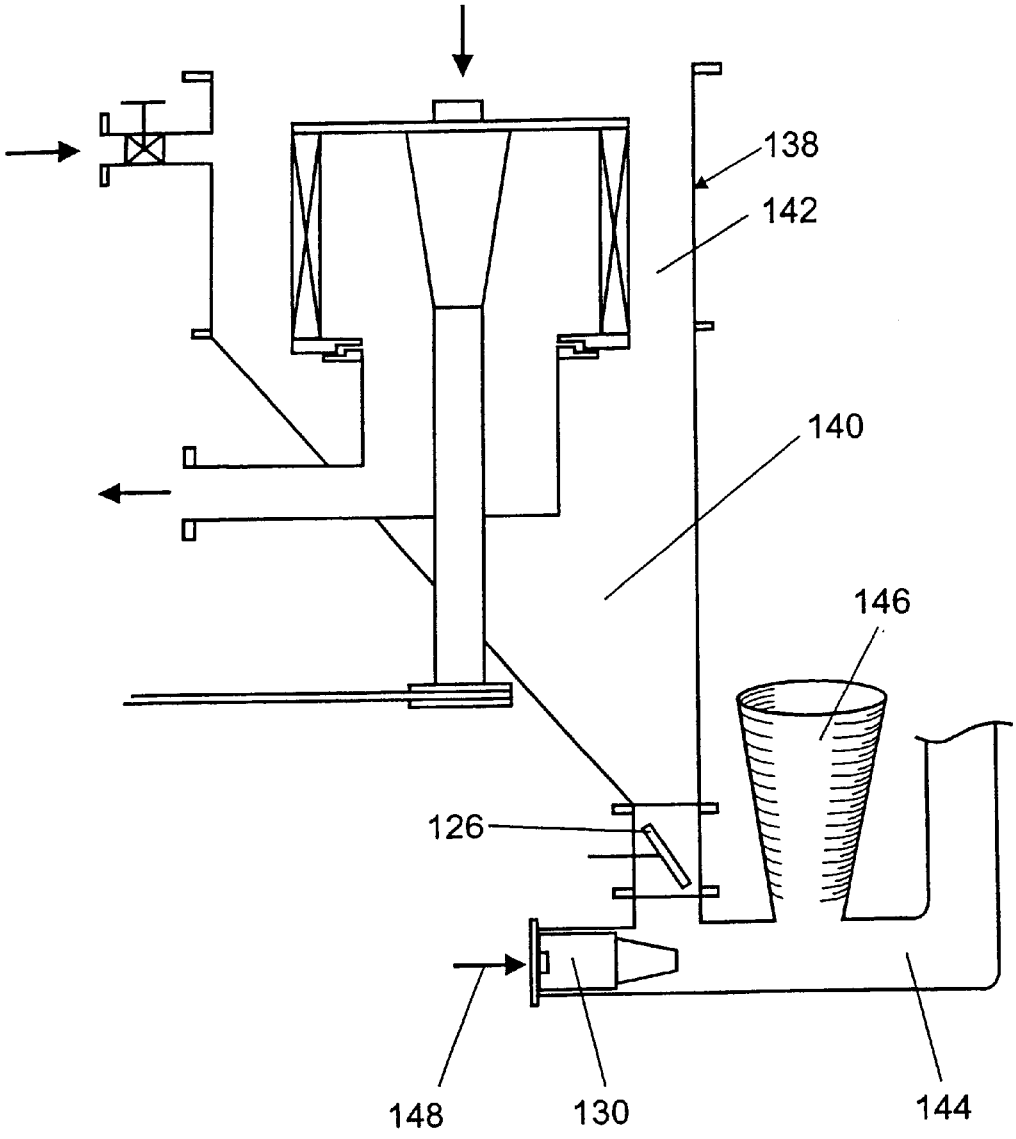

Referring to FIG. 9, the embodiment of the classifier portion 138 shown has an adjustable valve in the oversize particle collector 140. The oversize particle collector 140 includes a tapered or generally conical portion leading from classifying zone 142 to the valve 126 to collect the oversize particles, while reducing or eliminating any areas which would potentially trap the oversize particles prior to reaching the return manifold 144. Due to the steep walls of the oversize particle collector 140, gravity assists in transporting the oversize particles to the return manifold 144.

A feed inlet 146 is connected to the return manifold 144 downstream of the connection between the oversize particle collector 140 and the return manifold 144. A blower 130 is disposed upstream of or substantially at the oversize particle collector 140. In an alternative embodiment, the feed inlet 146 is connected to the return manifold, as shown in FIG. 8, with no blower present and optionally with an open end of the return manifold 140 to intake air 148 at atmospheric pressure outside of the housing.

While illustrative embodiments of the invention are disclosed herein, it will be appreciated that numerous modifications and other embodiment may be devised by those skilled in the art. Therefore, it will be understood that the appended claims are intended to cover all such modifications and embodiments that come within the spirit and scope of the present invention.

What is claimed is:

1. An apparatus for operating on particulate material, comprising:

a housing configured for containing a stream of particulate material;

a particulate material feed inlet associated with the housing for introducing the particulate material into the housing;

a milling assembly disposed within the housing and configured for grinding the particulate material into fines and coarse particles;

a classifier comprising a classifier rotor, disposed within the housing and below the milling assembly, and configured for separating the fines from the coarse particles;

a fines output at the underside of the classifier configured for extracting the fines from the classifier; and a coarse particle collector at the underside of the classifier and configured for extracting the coarse particles from the housing;

wherein the classifying mill is arranged such that the particulate material stream extends downward from the feed inlet, through the milling assembly, and subsequently through the classifier.

2. The apparatus of claim 1, wherein:

the housing comprises a milling portion;

the milling assembly comprises a long-gap milling assembly milling rotor that has a radially outward portion extending to adjacent the housing and defining a milling gap between the outward portion and the housing; and the rotor and the milling portion of the housing are configured for grinding the particulate material in the milling gap upon rotation of the rotor with respect to the housing.

3. The apparatus of claim 2, wherein the outward portion of the milling rotor comprises a plurality of beater plates.

4. The apparatus of claim 2, wherein the milling assembly is configured such that the stream flows lengthwise between sides of the gap of the milling assembly.

5. The apparatus of claim 4, wherein the milling assembly is configured such that the stream flows generally axially along the gap of the milling assembly.

6. The apparatus of claim 1, wherein the milling assembly is configured to reduce a product to a median size of below 100 $\mu$m.

7. The apparatus of claim 1, further comprising an air supply assembly for feeding air into the housing for carrying the material stream.

8. The apparatus of claim 1, wherein the housing is oriented substantially upright.

9. The apparatus of claim 1, further comprising a particle return manifold associated with the coarse particle outlet and the housing at a location for returning the coarse particles to the housing for feeding the coarse particles through the milling assembly.

10. The apparatus of claim 9, further comprising a blower connected to the particle return manifold for improving the flow of the coarse particles in the return manifold to the milling assembly.

11. The apparatus of claim 1, wherein housing comprises a plurality of particle return inlets each configured for connection to a particle return manifold for feeding the coarse particles from the coarse particle collector to the milling assembly.

12. The apparatus of claim 1, wherein the milling portion of the housing comprises a removable lining with ridges configured for increasing the grinding of the particulate material.

13. The apparatus of claim 1, further comprising:

a drive shaft drivingly associated with the milling rotor; and a bearing assembly supporting the drive shaft and disposed within the milling rotor.

14. The apparatus of claim 1, wherein the feed inlet is configured and disposed for introducing the particulate material into the milling assembly at an introduction location, the feed inlet comprising a loading portion configured for receiving the particulate material at a filling location below the introduction location for delivery to the introduction location.

15. The apparatus of claim 1, further comprising:

a particle return manifold connected with the coarse particle collector at a first location and associated with the housing for returning the coarse particles to the milling assembly; and a blower connected to the particle return manifold for blowing a fluid for carrying the material in the particle return manifold in relation to the first location and at an angle to the coarse particle collector for reducing the pressure in the coarse particle collector.

16. The apparatus of claim 15, further comprising an adjustable valve disposed in the coarse particle collector for controlling the pressure therein.

17. The apparatus of claim 15, wherein the feed inlet is connected to the particle return manifold.

18. The apparatus of claim 17, wherein the feed inlet is connected to the particle return manifold downstream of the blower.

19. An apparatus for operating on particulate material, comprising:

a housing configured for containing a stream of particulate material and comprising a first wall portion;

a particulate material feed inlet associated with the housing for introducing the particulate material into the housing;

a milling assembly disposed within the housing and configured for grinding the particulate material into fines and coarse particles;

a classifier comprising a classifier rotor, disposed within the housing and below the milling assembly, and configured for separating the fines from the coarse particles;

a fines output associated with the classifier rotor for extracting the fines from the classifier;

a coarse particle collector disposed adjacent the first wall portion and radially outward from the fines output with respect to the rotor at the underside of the classifier and configured for extracting the coarse particles from the housing; and a sweeper disposed adjacent the rotor and the first wall portion and movable with respect to the first wall portion in a sweeper direction along a sweeper path for removing the particulate material from adjacent the first wall portion, the sweeper comprising a leading side facing substantially in the sweeper direction;

wherein the classifying mill is arranged such that the particulate material stream extends downward from the feed inlet, through the milling assembly, and subsequently through the classifier.

20. The apparatus of claim 19, wherein the sweeper is rotatable coaxially with respect to the rotor.

21. The apparatus of claim 19, wherein the sweeper comprises a sweeper extension that extends into the material stream disposed for moving the particulate material away from the first wall portion, the sweeper extension comprising the leading side.

22. The apparatus of claim 21, wherein the extension comprises a plurality of fins.

23. The apparatus of claim 19, wherein the sweeper is configured for moving the particulate material around the rotor.

24. The apparatus of claim 19, wherein the leading side is angled away from the first wall portion.

25. The apparatus of claim 19, wherein the first wall portion is disposed below the rotor.

26. The apparatus of claim 19, wherein the coarse particle collector is open to the housing at less than the complete circumference thereof.

27. The apparatus of claim 19, wherein the sweeper comprises an outermost portion, and the classifier comprising a first fluid inlet disposed adjacent the first wall portion and radially inward from the outermost portion of the sweeper, wherein the first fluid inlet is configured for increasing the fluid flow from within the sweeper for moving the particulate material centrifugally from the sweeper.

28. An apparatus for operating on particulate material, comprising:

a housing configured for containing a stream of particulate material;

a particulate material feed inlet associated with the housing for introducing the particulate material into the housing;

a milling assembly disposed within the housing and configured for grinding the particulate material into fines and coarse particles;

a classifier comprising a classifier rotor, disposed within the housing and below the milling assembly, and configured for separating the fines from the coarse particles;

a fines output associated with the classifier rotor for extracting the fines from the classifier;

a coarse particle collector disposed and radially outward from the fines output with respect to the rotor at the underside of the classifier and configured for extracting the coarse particles from the housing;

a classifying fluid inlet configured for feeding classifying fluid into the classifier; and a guide channel connected with the fluid inlet for receiving the classifying fluid from the classifying fluid inlet and guiding the classifying fluid along a channel path, the guide channel extending substantially coaxially with the rotor and defining first and second orifices fluidly communicated with the housing, wherein the second orifice is disposed further along the path than the first orifice and is larger than the first orifice;

wherein the classifying mill is arranged such that the particulate material stream extends downward from the feed inlet, through the milling assembly, and subsequently through the classifier.

29. The apparatus of claim 28, wherein the guide channel defines a third orifice fluidly communicated with the housing, disposed further along the path than second orifice, and being larger than the second orifice.

30. The apparatus of claim 28, wherein the orifices are sized for feeding the classifying fluid into the housing at about a same rate through each orifice.

31. The apparatus of claim 28, wherein the guide channel has a substantially constant width across the flow of the classifying fluid.

32. An apparatus for operating on particulate material, comprising:

a housing configured for containing a stream of particulate material;

a particulate material feed inlet associated with the housing for introducing the particulate material into the housing;

a milling assembly disposed within the housing and configured for grinding the particulate material into fines and coarse particles;

a classifier comprising a classifier rotor, disposed within the housing and below the milling assembly, and configured for separating the fines from the coarse particles;

a fines output associated with the classifier rotor for extracting the fines from the classifier;

a coarse particle collector disposed and radially outward from the fines output with respect to the rotor at the underside of the classifier and configured for extracting the coarse particles from the housing;

a classifying fluid inlet configured for feeding classifying fluid into the classifier; and a guide channel having a guide channel radius and being connected with the fluid inlet for receiving the classifying fluid from the classifying fluid inlet and guiding the classifying fluid along a path, the guide channel extending substantially coaxially with the rotor and defining a plurality of orifices oriented at an angle of more than about 30° to the guide channel radius;

wherein the classifying mill is arranged such that the particulate material stream extends downward from the feed inlet, through the milling assembly, and subsequently through the classifier.

33. The apparatus of claim 32, wherein at least one of the orifices is tapered towards the interior of the housing.

34. A method of grinding and classifying particulate material, comprising:

feeding particulate material to fall through into a milling rotor in a housing;

grinding the particulate material into fines and coarse particles with the milling rotor;

dropping the ground particulate material from the milling rotor to a classifier rotor in the housing below the milling rotor;

classifying the fines from the coarse particles with the classifier rotor; and separately removing the classified fines and the coarse particles.

35. The method of claim 32, further comprising:

returning the coarse particles through a return manifold to fall through the milling rotor; and grinding the returned coarse particles with the milling rotor.

* * * * *

UNITED STATES PATENT AND TRADEMARK OFFICE

CERTIFICATE OF CORRECTION

PATENT NO. : 6,534,709 B2
DATED : April 8, 2003
INVENTOR(S) : Huang et al.

It is certified that error appears in the above-identified patent and that said Letters Patent is hereby corrected as shown below:

Column 16,
Line 41, change "claim 32," to -- claim 34, --.

Signed and Sealed this

First Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,543,709 B2
DATED : April 8, 2003
INVENTOR(S) : Huang et al.

It is certified that error appears in the above-identified patent and that said Letters Patent is hereby corrected as shown below:

Column 16,
Line 41, change "claim 32," to -- claim 34, --.

Signed and Sealed this

Twenty-second Day of June, 2004

JON W. DUDAS
*Acting Director of the United States Patent and Trademark Office*